US006361873B1

(12) United States Patent
Yong et al.

(10) Patent No.: US 6,361,873 B1
(45) **Date of Patent: *Mar. 26, 2002**

(54) COMPOSITE CONSTRUCTIONS HAVING ORDERED MICROSTRUCTURES

(75) Inventors: Zhou Yong, Spring; Sujian J. Huang, The Woodlands; Michael A. Siracki, The Woodlands; Chris Cawthorne, The Woodlands; J. Albert Sue, The Woodlands; Ghanshyam Rai, The Woodlands; Zhigang Fang, The Woodlands, all of TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/499,929

(22) Filed: Feb. 8, 2000

Related U.S. Application Data

(63) Continuation-in-part of application No. 08/903,668, filed on Jul. 31, 1997, now Pat. No. 6,063,502.

(51) Int. Cl.[7] ..... B22F 3/00; C22C 1/99

(52) U.S. Cl. ..... 428/469; 428/698; 428/408; 175/425; 175/426; 175/434

(58) Field of Search ..... 428/469, 698, 428/408; 175/425, 426, 434

(56) References Cited

U.S. PATENT DOCUMENTS

| | | | | |
|---|---|---|---|---|
| 4,255,165 A | | 3/1981 | Dennis et al. | 51/309 |
| 4,378,975 A | | 4/1983 | Tomlinson et al. | 51/309 |
| 4,772,524 A | | 9/1988 | Cobienz | 428/699 |
| 5,419,868 A | | 5/1995 | Honnorat | 419/4 |
| 5,441,817 A | * | 8/1995 | Rai | |
| 5,645,781 A | | 7/1997 | Popovic et al. | 264/639 |
| 5,662,183 A | * | 9/1997 | Fang | |
| 5,813,105 A | * | 9/1998 | Littecke et al. | |
| 5,830,813 A | * | 11/1998 | Yao et al. | |
| 5,880,382 A | * | 3/1999 | Fang et al. | |
| 5,944,127 A | * | 8/1999 | Liang et al. | |

FOREIGN PATENT DOCUMENTS

GB 1572460 7/1980

OTHER PUBLICATIONS

Technological Advances, *Flaw Tolerant, Fracture Resistant, Non–Brittle Materials Produced via Conventional Powder Processing*, 1995 Matrice Technology Ltd., p. 131–134.

Advance Ceramics Research, *Research & Development Summaries*, Aug. 18, 1996, 4 Summaries, 2 to 3 pages each.

* cited by examiner

*Primary Examiner*—Deborah Jones
*Assistant Examiner*—Jason Savage
(74) *Attorney, Agent, or Firm*—Christie, Parker & Hale, LLP

(57) ABSTRACT

Composite constructions of this invention comprise an ordered microstructure made up of multiple structural units that can be the same or different, and that comprise at least a first structural phase and a second structural phase. The first structural phase comprises a hard material that is selected from the group consisting of cermet materials, PCD, PCBN and mixtures thereof. The second structural phase is in contact with the first phase and comprises a material that is different than that selected to form the first structural phase. Additionally, the second structural phase is in contact with at least a portion of the first structural phase. Composite constructions of this invention can also have a multi-layer structures comprising two or more layers, wherein at least one of the layers comprises a composite construction having an ordered microstructure made up of the multiple structural units described above.

41 Claims, 5 Drawing Sheets

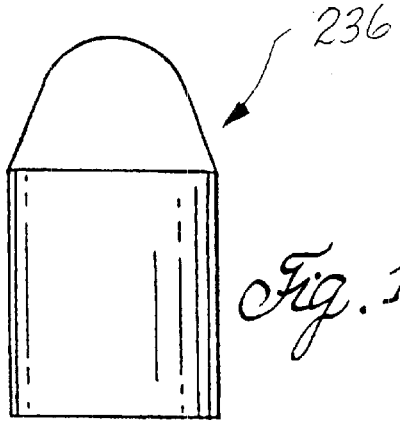
Fig. 13
Fig. 15
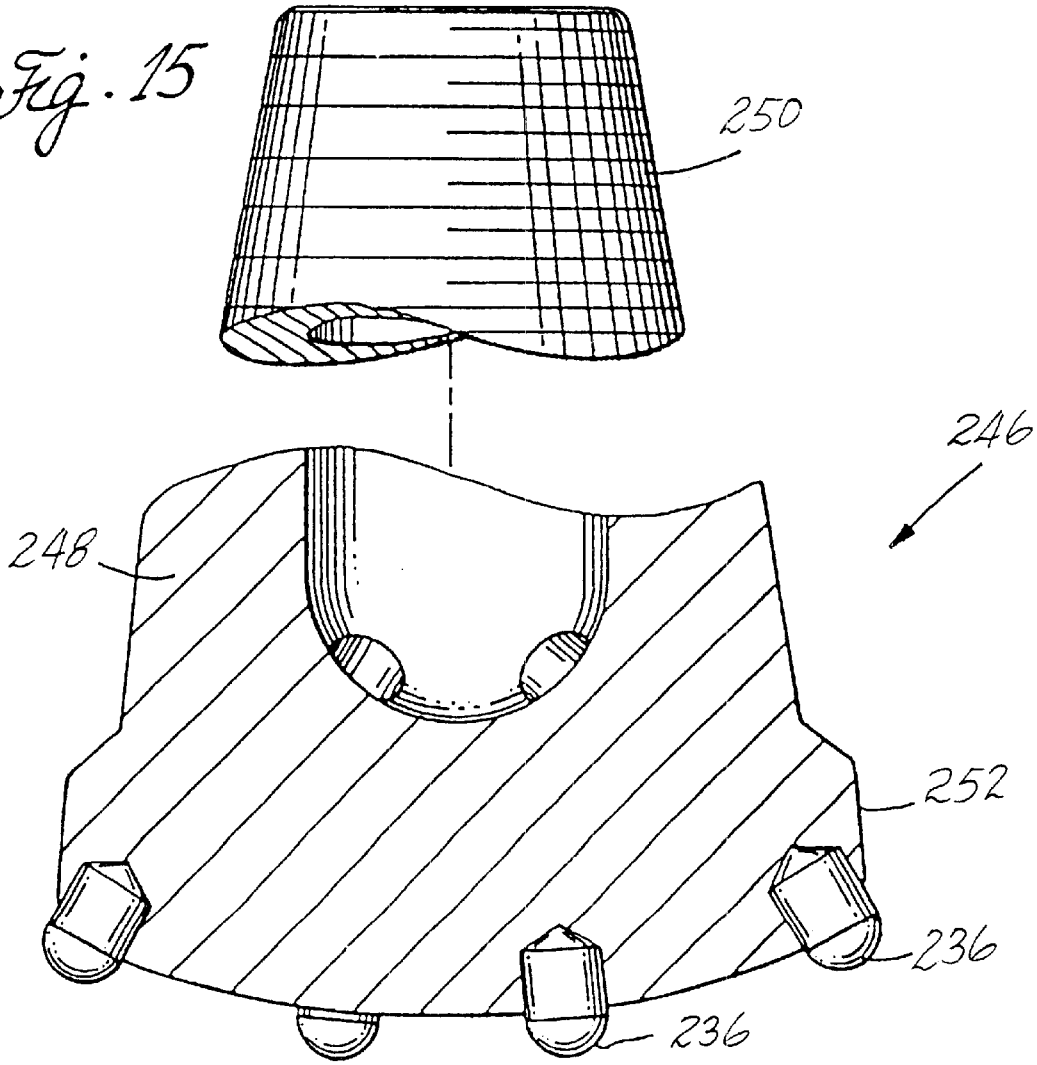

COMPOSITE CONSTRUCTIONS HAVING ORDERED MICROSTRUCTURES

RELATION TO COPENDING PATENT APPLICATIONS

This patent application is a continuation in part of U.S. patent application Ser. No. 08/903,668 filed on Jul. 31, 1997, now U.S. Pat. No. 6,063,502, which application is incorporated herein by reference.

FIELD OF THE INVENTION

This invention relates generally to composite constructions comprising a hard material phase and a relatively softer ductile material phase and, more particularly, to composite constructions having an ordered microstructure of polycrystalline diamond and a relatively softer ductile material to provide improved mechanical and/or thermal properties, when compared to traditional constructions formed from polycrystalline diamond alone.

BACKGROUND OF THE INVENTION

Polycrystalline diamond (PCD) and polycrystalline cubic boron nitride (PCBN) constructions, synthesized by high temperature/high pressure processes, are well known for their mechanical properties of hardness and wear resistance, making them a popular material choice for use in such industrial applications as cutting tools for machining, mining and drilling where such mechanical properties are highly desired. For example, PCD and PCBN constructions are provided in the form of surface coatings on, e.g., inserts used with cutting and drilling tools to impart properties of hardness and wear resistance thereto.

Traditionally, such PCD and PCBN inserts are formed by coating a carbide substrate with one or two layers of PCD or PCBN. Such inserts comprise a substrate, a surface layer, and often a transition layer to improve the bonding between the exposed layer and the support layer. The substrate is, most preferably, a carbide substrate, e.g., cemented carbide, tungsten carbide (WC) cemented with cobalt (WC—Co). The coated layer or layers of PCD conventionally comprises a metal content from 10% to 30% by weight to facilitate intercrystallline bonding and bonding of the layers to each other and to the underlying substrate. Metals employed are often selected from cobalt, iron, or nickel and/or mixtures or alloys thereof and can include metals such as manganese, tantalum, chromium and/or mixtures or alloys thereof. However, while higher metal content typically increases toughness, higher metal content also decreases hardness, thereby limiting the flexibility of providing coatings with the requisite properties. Additionally, when variables are selected to increase hardness, typically brittleness also increases, thereby reducing the toughness of the cutting element.

Generally, PCD and PCBN each exhibit extremely high hardness and provide a high degree of wear protection to a cutting element. However, in more complex wear environments causing impact and fretting fatigue, layers comprising PCD and PCBN may fail by gross chipping and spalling. For example, inserts coated with a thick PCD monolayer may exhibit brittleness that causes substantial problems in practical applications. Conventional methods of improving the performance of PCD or PCBN layers include controlling particle size to maximize toughness, but the effect is limited.

It is, therefore, desired that PCD and PCBN composite constructions be provided that are specifically designed to have improved properties of fracture toughness, when compared to conventional PCD and PCBN constructions, hereby reducing the potential for conventional PCD and PCBN failure modes of spalling and/or chipping. It is desirable that PCD and PCBN composite constructions have such improved fracture toughness without sacrificing other desirable properties of wear resistance and hardness associated with the PCD and PCBN materials. It is desired that such composite constructions be adapted for use in such applications as cutting tools, roller cone bits, hammer bits, drag bits and other mining, construction and machine applications where properties of improved fracture toughness is desired.

SUMMARY OF THE INVENTION

Composite constructions of this invention generally comprise an ordered microstructure of multiple structural units that each comprise at least a first structural phase and a second structural phase that are intentionally arranged and formed from materials that are selected to provide improved properties of fracture toughness when compared to traditional materials formed from PCD or PCBN alone.

A structural unit first structural phase comprises a hard material that is selected from the group consisting of cermet materials, PCD, PCBN and mixtures thereof. A structural unit second structural phase comprises a material that is different than that selected to form the first structural phase, e.g., one that is relatively softer and/or more ductile that the material selected for the first structural phase. Additionally, the second structural phase is in contact with at least a portion of the first structural phase.

Composite constructions of this invention having order microstructures may also take the form of multi-layer structures. Such multi-layer constructions comprise two or more layers, e.g., a first layer and at least a second layer disposed onto a surface of the first layer. In such multi-layer embodiment, at least one of the layers comprises a composite construction having an ordered microstructure made up of the multiple structural units that are formed from the materials as described above.

Composite constructions of this invention provide improved properties of fracture toughness, when compared to conventional non-composite materials comprising PCD or PCBN alone, without substantially sacrificing other desired properties of wear resistance and hardness, thereby reducing the potential for material failure by spalling and/or chipping.

DESCRIPTION OF THE DRAWINGS

These and other features and advantages of the present invention will become appreciated as the same becomes better understood with reference to the specification, claims and drawings wherein:

FIG. 13 is a perspective side view of an insert for use in a roller cone or a hammer drill bit comprising a composite construction of this invention;

FIG. 15 is a perspective side view of a percussion or hammer bit comprising a number of inserts of FIG. 13;

DETAILED DESCRIPTION OF THE INVENTION

Composite constructions, prepared according to the principles of this invention, have an ordered microstructure made up of multiple structural units that each comprise particularly arranged structural phases. Each such structural unit generally comprises a first PCD or PCBN phase, with at least one other phase formed from a relatively softer and more ductile material. The structural unit or units used to form the ordered microstructure for composite constructions of this invention can include structural phases that provide a continuous or noncontinuous material phase throughout the microstructure.

Composite constructions of this invention comprising such ordered microstructures are designed to improve the fracture toughness and/or thermal properties of the composite while controlling and not substantially sacrificing desired properties of hardness and wear resistance. Composite constructions of this invention thereby increase the overall flexibility of using PCD and PCBN in a wider range of applications than otherwise possible with traditional PCD and PCBN constructions.

Figure 1:
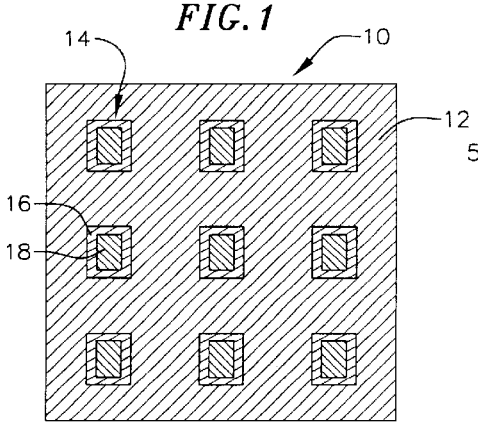
FIG. 1 is a schematic cross-sectional plan view of a first embodiment composite construction of this invention.

FIG. 1 illustrates a first composite construction 10 of this invention having an ordered microstructure comprising a plurality of identical structural units that each comprise a continuous first structural phase 12 formed from a relatively hard material, and a second structural phase 14 distributed in an ordered fashion within the first phase and formed from a relatively softer more ductile material. In an example embodiment, the first phase is formed from PCD or PCBN that can be prepared according to the process described in U.S. Pat. Nos. 4,604.106; 4,694,918; 5,441,817; and 5,271,749 that are each incorporated herein by reference, starting with diamond or cBN powder and wax. Example PCD and PCBN materials useful for forming the first phase include PCD, PCBN, mixtures of PCD and PCBN with carbides, borides, carbonitrides, and nitrides of the group IVa, Va, and VIa metals and metal alloys of the periodic table.

In an example embodiment, the second phase 14 is formed from materials selected from the group including ceramic materials, cermet materials, metals, metal alloys, and mixtures thereof. Example ceramic materials useful for forming the second phase include metal carbides, borides, silicides, and cubic boron nitride (cBN). Example cermet materials include carbides, borides and nitrides of the group IVa, Va, and VIa metals and metal alloys of the periodic table, such as WC—M, TiC—M, TaC—M, VC—M, and $Cr_3C_2$—M, where M is a metal such as Co, Ni, Fe, or alloys thereof as described above.

Example metals and metal alloys useful for forming the second phase can be selected from the group IVa, Va, and VIa ductile metals and metal alloys including, but not limited to Fe, Ni, Co, Cu, Ti, Al, Ta, Mo, Nb, W, and their alloys. Additionally, the second phase can be formed from the group including carbides, borides, nitrides, and carbonitrides of the group IVa, Va, and VIa metals and metal alloys of the periodic table, as these materials provide desired properties of good thermal expansion compatibility with PCD and PCBN and good toughness. For example, the second phase can be WC—Co when the hard phase material is PCD or PCBN.

The second phase 14 can be formed from either a single material, or can be formed from more than one material. For example, the second phase 14 can be in the form of an ordered distribution of a single different material within the continuous first phase 12, or can be in the form of two or more materials distributed within the continuous first phase 12. As illustrated in FIG. 1, the second phase 14 is in the form of a shell 16 and a core 18, each formed from different materials. In such embodiment, the core 18 is preferably formed from a material selected from the list of second phase materials set forth above, having desired properties of ductility to increase the fracture toughness of the composite construction. The shell 16 in such embodiment is preferably formed from a material, also selected from the list of second phase materials set forth above, having desired properties of ductility in addition to properties of thermal expansion that are intermediate to both PCD or PCBN forming the first phase and the second phase core material, thereby serving to control thermal stress generation between the first and second phases.

First embodiment composite constructions of this invention display improved properties of toughness and improved thermal properties when compared to traditional PCD or PCBN constructions, without undesired losses of wear resistance and hardness, thereby providing increased composite construction applicability, i.e., uses of PCD or PCBN constructions in a wider variety of applications and application conditions, and increased composite construction service life.

Composite constructions prepared according to principles of this invention can take the form of different structures depending on the particular application. For example, such composite constructions can be in the form of a coating or thick section applied to an underlying substrate formed from a different material to impart properties of hardness and wear resistance to the substrate. Alternatively, the composite construction can be in the form of the article itself, i.e., be used to form the article rather than disposed on a surface of the article as a coating. In either case, it is preferred that the composite construction comprising the ordered microstructure be a working surface of any such article.

Additionally, the different structural units and structural phases making up each unit in the composite construction ordered microstructure can take on different geometric shapes. For example, the second phase 14 in the first embodiment is illustrated as having a generally rectangular cross-sectional shape. It is to be understood, however, that the shape of each phase in this embodiment or any other embodiment may vary depending on the method of manufacture, the particular application and desired microstructure, and may not be in a perfect geometric shape, e.g., a rectangle, square, triangle and the like, as illustrated in the respective figures.

Additionally, while in this first embodiment the first structural phase was described as being formed from a relatively harder material than that used to form the second phase, it is to be understood that the materials used to form the first and second structural phases can be interchanged without departing from the spirit of this invention.

An exemplary first embodiment composite construction of this invention is prepared by co-extruding rods of the core 18 material with the shell 16 material to form rods making up the second phase 14 material. Rods of the second phase material are then bundled with rods of the first phase 12 material, and co-extruded together to form a final rod of final composite construction 10 material. Thin wafers of the final composite 10 are then cut off of the rod and are then formed to the general shape of the layer geometry. The wafer thickness is determined by the final thickness desired of the coating, section thickness or insert size. The insert is then assembled and sintered according to typical processes known in the art.

Figure 2:
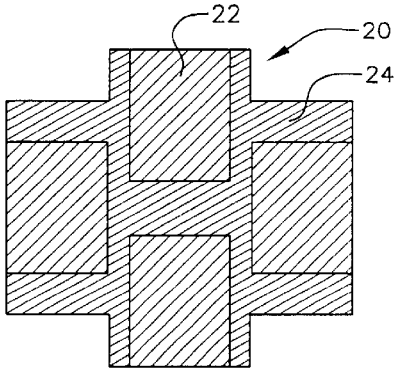
FIG. 2 is a schematic cross-sectional plan view of a second embodiment composite construction of this invention.

FIG. 2 illustrates a second embodiment composite construction 20 having an ordered microstructure comprising a plurality of structural units that each comprise a noncontinuous hard first structural phase 22 surrounded by a continuous relatively softer more ductile second structural phase 24. The structural units are combined with one another such that the respective second phases of each unit are in contact with one another, forming a continuous ductile phase throughout the composite microstructure. The Materials useful for forming the first and second phases 22 and 24 are selected from the same groups of materials discussed above for the first embodiment. This composite construction embodiment displays a greater degree of toughness than that of the first embodiment due to the presence of a continuous ductile second phase, which operates to help blunt crack propagation from the hard phase through the composite, thereby operating to control fracture-related material fatigue and failure.

Generally, the continuous second phase 24 in the second embodiment composite construction acts as a binder to surround the first phase 22 hard material to control the fracture toughness of the composite construction. Plastic deformation of the binder phase during the crack propagation process accounts for more than 90 percent of the fracture energy. The second embodiment composite constructions of this invention are designed having a maximum fracture path through the second or binder phase, thereby improving the ability of the composite to blunt or deflect the tip of a propagating crack. For example, roller cone rock bit inserts that are manufactured from or that are coated with second embodiment composite constructions of this invention are known to display increased fracture toughness when compared to conventional PCD materials, resulting in extended service life.

The structural arrangement of the first hard phase material and the second binder phase in composite constructions of this invention may take several forms. For example, while in FIGS. 1 and 2 the second phase and first phase, respectively, are illustrated having a square or rectangular cross-sectional configurations, it is to be understood that the phases in each composite construction microstructure can be designed having other cross-sectional geometric shapes, e.g., circular, oval, or trapezoidal. The particular shape of each microstructure depends on the particular mechanical and thermal properties desired for the composite, which in turn depends on the type of composite construction application, the operating conditions for the application, and the types of materials selected to form the first and second phases. An additional constraint in defining the desired shape of each phase is the manufacturing capability, i.e., whether the theoretically most desirable shape is practically manufacturable.

An exemplary second embodiment composite construction of this invention is prepared by method similar to that described above for the first embodiment and illustrated in FIG. 1, wherein rods are formed of the first phase 22 material and shells of the second phase 24 material are formed. The shells are placed around the rods and are co-extruded together. Then multiples of the newly formed extrusions are bundled together and co-extruded together to form a final rod of the composite construction 20 material.

Figure 3:
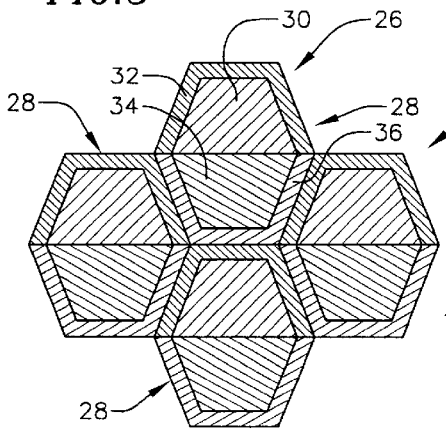
FIG. 3 is a schematic cross-sectional plan view of a third embodiment composite construction of this invention.

FIG. 3 illustrates a third embodiment composite construction 26 having an ordered microstructure made up of a plurality of identical structural units 28. Each such structural unit is made up of a hard first structural phase 30 surrounded along three wall surfaces by a relatively softer and more ductile second structural phase 32. The materials useful for forming the first and second phases are the same as those discussed above. Additionally, each structural unit 28 includes a third phase 34 that is placed into contact with the remaining first phase wall surface, and that is surrounded along three wall surfaces by a fourth phase 36. The third and fourth phases 34 and 36 are formed from the same types of materials discussed above for forming the second phase. The second, third and fourth phases can be formed from the same materials or can be formed from different materials depending on the particular composite construction application and desired performance characteristics.

In a preferred third embodiment, the second, third and fourth phases are each formed from different materials. The materials used for forming the second, third and fourth phases are selected to both provide a desired degree of ductility and fracture toughness to the composite, and to improve resistance to thermal stress related fracture. For example, it is desired that the second, third and fourth phases be formed from materials that have thermal expansion properties that complement one another, and that complement the first phase material, when the structural units are combined to form the ordered microstructure.

Third embodiment composite constructions of this invention are designed having reduced local contact stress and reduced crack propagation due both to the lack of a continuous first phase and to the presence of the remaining relatively more ductile phases surrounding the first phase. This third embodiment, provides such desired physical properties while still maintaining a desired degree of hardness and wear resistance.

In a preferred embodiment, each structural unit first phase 30 is formed from PCD, the second and fourth phases 32 and 36 are each formed from pre-cemented tungsten carbide, and the third phase is formed from PCD and pre-cemented tungsten carbide/cobalt. These second, third and fourth phase materials are preferred because they provide improved toughness over the first phase. The third phase material provides a closer thermal expansion coefficient to the first phase than the second and fourth phases to help reduce residual stresses. The second and fourth phase pre-cemented tungsten carbide/cobalt provides toughness to absorb impact energy during loading.

In the event that the second, third and fourth phases are formed from the same material, the combined phases would form a continuous phase that surrounds the first phase, making the third embodiment similar to that of the first embodiment. Although the structural units 28 are each illustrated having a trapezoidal cross-sectional shape, it is to be understood that the structural unit can be shaped differently as needed to provide desired performance characteristics and as limited by the manufacturing process. In a preferred embodiment, the structural units 28 have a generally hexagonal shape and each structural unit is surrounded by and in contact with six other structural units.

An exemplary third embodiment composite construction of this invention is prepared by co-extruding the desired materials in steps together as described earlier to achieve the final composite construction configuration.

Figure 4:
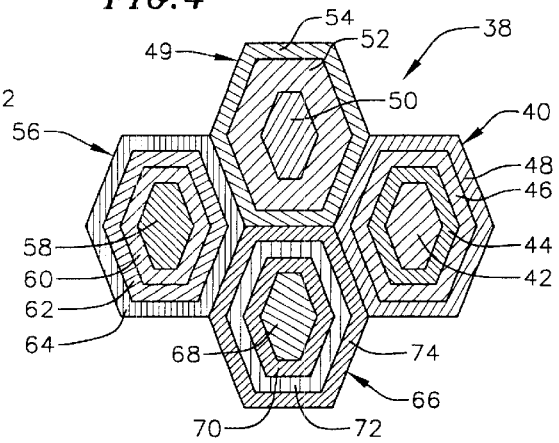
FIG. 4 is a schematic cross-sectional plan view of a fourth embodiment composite construction of this invention.

FIG. 4 illustrates a fourth embodiment composite construction 38 having an ordered microstructure comprising an arrangement of different structural units. Each of the structural units making up the microstructure has a number of concentrically arranged regions or closed cells that can be formed from different materials. Each structural unit includes one or more hard phases, and more than one relatively softer more ductile phases.

In an exemplary fourth embodiment, the ordered microstructure comprises an arrangement of at least four different structural units each having a generally hexagonal cross-sectional shape. A first structural unit 40 comprises, moving outwardly from a center point, a hard first phase 42 that forms a core of the first structural unit 40, and a softer and more ductile second phase 44 disposed concentrically around the first phase. The first and second phases can be formed from the same materials discussed above for the other composite construction embodiments. A hard third phase 46 is disposed concentrically around the second phase 44 and can be formed from the same hard material as the first phase, or can be formed from other hard materials used to form the first phase in the above-described embodiments. A fourth phase 48 is disposed concentrically around the third phase 46 and forms an outer shell of the first structural unit 40. The fourth phase can be formed from the same or different relatively softer and more ductile material as the second phase.

A second structural unit 49 is positioned next to one surface of the first structural unit 40 and comprises, moving outwardly from a center point, a soft and ductile first phase 50 that is surrounded by a hard second phase 52. A third phase 54 is disposed concentrically around the second phase 52, forming the outer shell, and is formed from a relatively softer and more ductile material. Unlike the first structural unit, the second structural unit 49 comprises only three concentrically arranged material regions, and only a single hard phase.

A third structural unit 56 is positioned next to one surface of the second structural unit 49 and comprises, moving outwardly from a center point, a relatively softer and ductile first phase 58 that is surrounded by a hard second phase 60. A third phase 62 is disposed concentrically around the second phase 60 and is formed from a relatively softer and more ductile material. A fourth phase 64 is disposed concentrically around the third phase 62, forming an outer shell of the third structural unit, and is formed from a soft and ductile material. Unlike the first and second structural units 40 and 49, the third structural unit 56 comprises a single hard phase and three soft phases.

A fourth structural unit 66 is positioned next to a surface of the first, second and third structural units 40, 49 and 56 respectively. The fourth structural unit 66 comprises, moving outwardly from a center point, a soft and ductile first phase 68 that is surrounded by a hard second phase 70. A third phase 72 is disposed concentrically around the second phase 70 and is formed from a relatively softer and more ductile material than the second phase. A fourth phase 74 is disposed concentrically around the third phase 72 and is formed from a soft and ductile material, and forms an outer shell of the third structural unit. The fourth structural unit 66 has is similar to the third structural unit, except that its fourth phase is formed from a hard material rather than a soft and ductile material.

In this embodiment, the composite microstructure is formed from a plurality of different structural units that may or may not be arranged in a repeating order. Additionally, there is neither a continuous soft ductile phase nor a continuous hard phase throughout the composite microstructure. The materials used to form the different regions in each of the structural units are selected to provide desired properties of improved toughness and crack resistance, reduced residual stress, reduced contact tensile stress, and improved thermal resistance to the composite construction. An advantage of the fourth embodiment composite construction is that residual stress can be distributed and lowered throughout the composite construction. Proper material selections can also reduce crack propagation when cracks develop.

An exemplary fourth embodiment composite construction of this invention is prepared by the similar extrusion process explained previously.

Although FIG. 4 depicts a microstructure comprising four different structural units 40, 49, 56 and 66, it is to be understood that this embodiment is intended to be illustrative of composite constructions of the inventions comprising microstructures having a plurality of different structural units.

It is believed, however, that composite constructions comprising a microstructure made up of at least one of the four structural units can provide a majority of the benefit derived therefrom, and be much easier to manufacture because one doesn't have to concern himself with the placement control of multiple different structural units. In a preferred embodiment of this configuration the first phase could be PCD and the phases surrounding it could be compositions of PCD and tungsten carbide/cobalt with decreasing amounts of PCD in the individual phases as you move away from the first phase. This configuration would reduce residual stress due to the thermal mismatch that exists when bonding materials together that have different coefficients of thermal expansion. In other applications it may be desirable that the even numbered phases, i.e. the second and fourth phases, surrounding the first phase contain PCD and the odd numbered phases do not contain PCD. Such an arrangement can provide reduced residual stress between the phases as well as provide optimized wear and/or strength and/or toughness.

Figure 5:
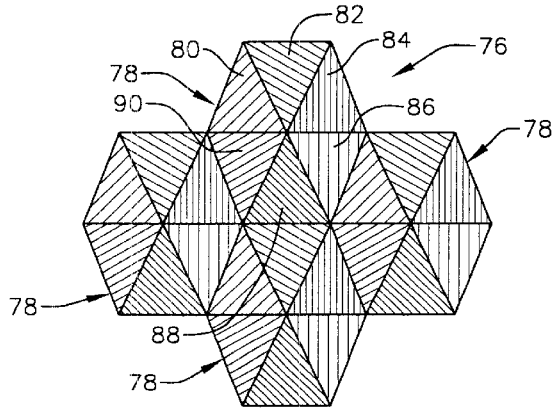
FIG. 5 is a schematic cross-sectional plan view of a fifth embodiment composite construction of this invention.

FIG. 5 illustrates a fifth embodiment composite construction 76 having an ordered microstructure comprising a repeating arrangement of identical structural units 78. Each structural unit 78 comprises an arrangement of multiple structural phases. In an example embodiment, each structural unit 78 has a generally hexagonal cross-sectional shape, resulting from the extrusion process, and comprises six different structural phases 78, 80, 82, 84, 86, 88 and 90. The materials for the six phases may be formed from the same phase materials discussed above for earlier invention embodiments, and can be selected such that the final structural unit is optimized for low residual stress between the phases, wear resistance on the working surface, and overall toughness and strength. By not requiring a thin shell or boundary around the individual phases or structural unit, this composite construction embodiment is relatively easier to manufacture and has higher yield rates.

Although each structural unit is illustrated having six different phases, such embodiment can comprise from as few as two phases to as many phases as the extrusion process will allow. Additionally, any two phases can be of the same material.

Additionally, if desired, the fifth embodiment composite construction microstructure can be formed from a plurality of different rather that the same type of structural units.

An exemplary fifth embodiment composite construction of this invention is prepared by taking rods of the materials selected for the individual phases in the desired ratio and bundling them and co-extruding them together, and then coextruding the bundles together to get the desired structural unit size and final rod size to cut wafers or sections from to form as discussed above in earlier embodiments of the invention.

Figure 6:
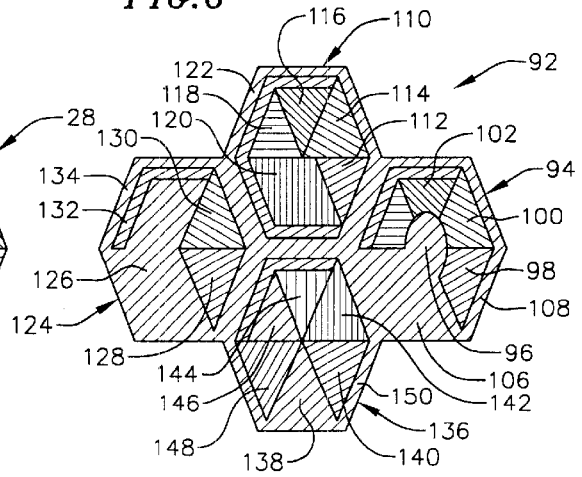
FIG. 6 is a schematic cross-sectional plan view of a sixth embodiment composite construction of this invention.

FIG. 6 illustrates a sixth embodiment composite construction 92 of this invention is somewhat similar to the fourth embodiment (of FIG. 4) in that both embodiments have an ordered microstructure that is made up of differently configured structural units. The sixth embodiment composite construction comprises an ordered microstructure that is a combination of the microstructures of the fourth and fifth embodiments. This embodiment is provided to illustrate how different ordered microstructures can be formed from the integration of different structural units, e.g., the integration of different patterns of hard and soft phases within each structural unit.

For example, each structural unit can include one or more hard phase or soft ductile phase each in the form of a triangular region, like the fifth embodiment as shown in FIG. 5, in the form of a cellular core region, like the fourth embodiment as shown in FIG. 4, and/or in the form of a cellular shell region, also like the fourth embodiment. In an exemplary embodiment, the sixth embodiment composite composition comprises an ordered microstructure having at least four different structural units that each have a generally hexagonal cross-sectional shape.

A first structural unit 94 comprises a hard first phase 96 that forms a core of the unit. A number of softer and more ductile phases surround the first phase and extend radially away from the core towards an edge of the first structural unit. Specifically, the first structural unit 94 includes second through fifth phases 98, 100, 102 and 104 that are each formed from different relatively softer and more ductile materials. The first structural unit 94 includes a hard sixth phase 106 that, like the second through fifth phases, extends radially away from the core 96. Additionally, the first structural unit 94 includes an outer shell 108 that is formed from a hard material.

A second structural unit 110 comprises first through fifth phases, 112, 114, 116, 118 and 120 that are each formed from soft and ductile materials. Each of phases 112, 114, 116 and 118 are in the form of a triangle and, in a preferred embodiment, are each formed from a different material. The sixth phase 120 comprises two triangles that are each formed from the same material that is different than the materials used to form the other soft and ductile phases. The second structural unit 110 includes an outer shell 122 that is formed from a hard material.

A third structural unit 124 comprises a first phase 126 that comprises four contiguous triangle shaped regions, and a second and third phase 128 and 130 each formed from a relatively softer and more ductile material. The second and third phases are each triangular in form. Two of the triangular first phase 126 regions include a shell portion 132 adjacent the structural unit edge that is formed from a soft and ductile material. The third structural unit, like the first and second structural units, includes an outer shell 134 that is formed from a hard material.

A fourth structural unit 136 comprises, moving clockwise, six generally triangular phases; namely, a first phase 138 formed from a hard material, second through fourth phases 140, 142, 144 each formed from different relatively softer and more ductile materials, a hard fifth phase 146, and a sixth phase 148 formed from a relatively soft and ductile material different than that used to form the second through fourth phases. The fourth structural phase 136 also includes an outer shell 150 that is formed from a hard material.

The sixth embodiment composite construction 92 is characterized in that it comprises a hard material in the form of a continuous phase running both throughout its microstructure, in the form of the structural unit outer shells, and within some of the structural units themselves located at different regions within each such structural unit. This embodiment is presented to illustrate the existence of unlimited material placements and orientations that can be provided in composite constructions of this invention in order to meet particular construction applications and operating conditions.

Generally speaking, composite constructions of this invention comprise an ordered microstructure formed from same or different types of multiple structural units. The structural units can be formed from at least two structural phases comprising, a hard phase and a relatively softer more ductile phase. The materials used to form, and the particular configurations of, the structural phases define the physical properties of the structural unit. The ordered arrangement of the so-formed structural units define the physical properties of the microstructure, and ultimately define the physical properties of the composite construction.

An important feature of composite constructions of this invention is the ability to tailor the construction of the structural phases and structural units to provide the ultimate physical properties desired for the composite construction. Composite constructions comprising an ordered microstructure having structural units comprising a PCD hard phase provide improved properties of fracture toughness when compared to conventional PCD materials.

The composite constructions discussed above and illustrated in FIGS. 1 to 6 can be used to form a single coating layer on an underlying substrate or form the whole cutting element, such as a rock bit insert or the like, or can be used to create multi-layer constructions comprising more than one coating of the same or different composite constructions.

FIGS. 7 to 12 illustrate different multi-layer constructions comprising composite constructions of this invention. Multi-layer constructions comprising composite constructions are formed using the techniques discussed above for the composite construction layers and using conventional techniques for forming the homogeneous layers. Homogeneous layers may be created by forming thin tapes or wafers using molds of the desired shape known in the art. The various layers may be formed independent of each other and assembled into a refractory mold for sintering, or may be formed one layer at a time on top of each other in a refractory mold and forming punch, which are common to those skilled in the art.

Figure 7:
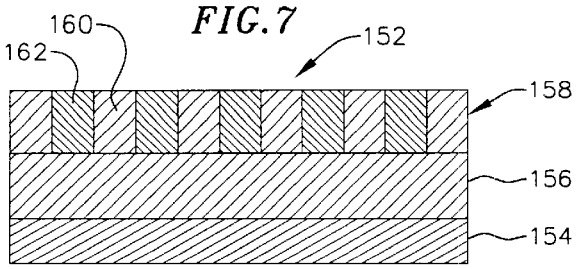
FIG. 7 is a schematic cross-sectional side view of a first embodiment multi-layer construction of this invention.

FIG. 7 illustrates, in schematic cross-sectional side view, a first embodiment multi-layer construction 152 of this invention comprising three different layers. A first layer 154 can be in the form of an underlying substrate surface or in the form of a discrete layer on a substrate, and is formed from the group of relatively softer and more ductile materials disclosed above. Alternatively, the first layer 154 can be formed from a mixture of hard and soft materials, thereby forming a transitional layer to reduce undesired thermal effects that may occur between the first layer and an adjacent layer of a different material. A second layer 156 is disposed onto a surface of the first layer 156 and is formed from a hard material selected from the group of hard materials discussed above.

In a preferred first multi-layer embodiment, the first layer is formed from transition materials such as a combination of the hard and soft materials discussed above, e.g., a mixture a PCB, cobalt and carbide. The second layer is formed from traditional PCD, e.g., a mixture of PCD and a small amount of metal such as cobalt, iron, or nickel. The third layer comprises a first continuous phase formed from PCD or PCBN, and a second phase formed from a softer and more ductile material.

A third layer 158 is disposed onto a surface of the second layer and in the form of a composite construction, i.e., comprises an ordered microstructure of more than one material phase. In an exemplary embodiment, the third layer 158 has an ordered microstructure that is similar to that of the first embodiment composite construction discussed above and illustrated in FIG. 1, comprising a continuous hard first phase 160 with a relatively softer and more ductile second phase 162 distributed therein. Alternatively, the third layer 158 could comprise a continuous soft and ductile phase with a hard phase distributed therein. Ultimately, the arrangement of hard and soft phase materials making up the ordered microstructure depends on the particular multi-layer construction application and operating conditions.

Configured in this manner, the presence of the soft material patches in the third layer provides an improved deformation and crack propagation blunting capacity when compared to PCD alone, thereby absorbing surface energy and reducing contact tensile stress. The second layer is configured having a reduced amount of flexibility, thereby acting to control and prevent the third layer from bending. Finally, the first layer provides properties of improved thermal matching, thereby controlling the creation of thermal stresses between the first and second layers. Another advantage of this particular embodiment, is that the construction comprising a second layer formed from PCD will continue to provide a high degree of wear resistance should the third surface layer be worn.

For this first multi-layer embodiment and other multi-layer embodiments of this invention it is to be understood that the individual layer thickness can and will vary depending on such factors as the particular microstructure of each individual layer, the materials used to form the microstructure of each individual layer, and the particular multi-layer composite construction application. For example, multi-layer composite constructions of this invention can have a total layer thickness of less than or greater than approximately 2-½ millimeters.

Figure 8:
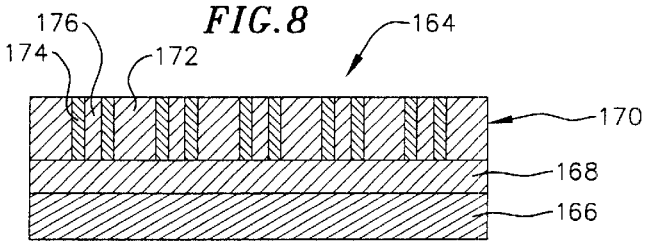
FIG. 8 is a schematic cross-sectional side view of a second embodiment multi-layer construction of this invention.

FIG. 8 illustrates, in schematic cross-sectional side view, a second embodiment multi-layer construction 164 of this invention comprising three different layers. This embodiment is similar to the first multi-layer embodiment described above except that the composite construction surface layer is configured differently. The second multi-layer embodiment comprises the same first and second layers 166 and 168 as disclosed above for the first multi-layer embodiment.

A third layer 170 is disposed onto a surface of the second layer and is in the form of a composite construction, i.e., comprises an ordered microstructure of more than one material phase. In an exemplary embodiment, the third layer 170 has an ordered microstructure comprising a continuous hard first phase 172, and a second phase distributed therein comprising a shell 174 formed from a relatively softer and more ductile material, that surrounds a core 176 formed from hard material. Compared to the first multi-layer embodiment, the second multi-layer embodiment also provides improved properties of deformation and crack propagation blunting when compared to a convention PCD layer. Although the soft material regions in the third layer are thinner than that of the first multi-layer embodiment, they still function to shorten and control cracks formed within the microstructure.

Figure 9:
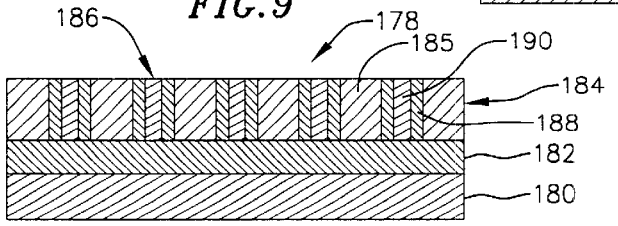
FIG. 9 is a schematic cross-sectional side view of a third embodiment multi-layer construction of this invention.

FIG. 9 illustrates, in schematic cross-sectional side view, a third embodiment multi-layer construction 178 of this invention comprising three different layers. This embodiment comprises a first layer 180 formed from a relatively soft and ductile material, and a second layer 182 disposed onto a surface of the first layer 180 that is also formed from a relatively soft and ductile material. The materials useful for forming the first and second layers 180 and 182 are the same ones discussed above, and the first and second layers can be formed from the same or different such materials.

A third layer 184 is disposed onto a surface of the second layer 182 and is in the form of a composite construction, i.e., comprises an ordered microstructure of more than one material phase. In an exemplary embodiment, the third layer 182 has an ordered microstructure comprising a continuous hard first phase 185, e.g., formed from PCD or PCBN, and a second phase 186 distributed therein comprising a shell 188, formed from a relatively softer and more ductile material, that surrounds a core 190 also formed from a relatively soft and ductile material. The shell and core can be formed from the same or different materials.

Unlike the first and second multi-layer embodiments, the third multi-layer embodiment comprises a third layer composite construction comprising regions of two different types of soft and ductile materials within the continuous hard phase. Additionally, this particular embodiment comprises first and second layers that are also formed from two different non-PCD materials. The use of the different non-PCD materials both within the third layer microstructure, and within the first and second layers of the multi-layer construction, provides properties of reduced thermal stress, as slow changes of material gradient can be achieved by placing more than one type of non-PCD material adjacent one another, both inter and intra layer. In addition, the placement of different non-PCD materials within the composite acts to improve bonding quality between the construction material interfaces, thereby improving the construction integrity of the multi-layer construction.

Figure 10:
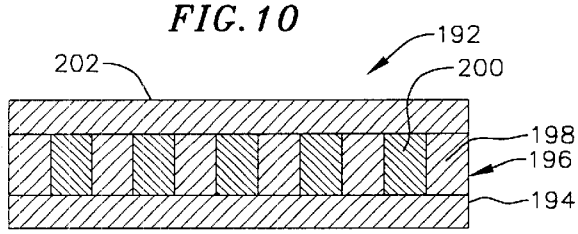
FIG. 10 is a schematic cross-sectional side view of a fourth embodiment multi-layer construction of this invention.

FIG. 10 illustrates, in schematic cross-sectional side view, a fourth embodiment multi-layer construction 192 of this invention comprising three different layers. This embodiment comprises a first layer 194 that is formed from one of the hard materials discussed above. A second layer 196 is disposed onto a surface of the first layer 194, and is in the form of a composite construction comprising an ordered microstructure of two different material phases. In an example embodiment, the second layer 196 is in the same form as the third layer in the first multi-layer embodiment discussed above and illustrated in FIG. 7, comprising a continuous first phase 198 formed from a hard material, e.g., PCD or PCBN, and a second phase 200 of a relatively softer and more ductile material dispensed therein.

A third layer 202 is disposed onto a surface of the second layer and is formed from a hard material selected from the group of hard materials discussed above, which can be the same or different from the material selected to form the first layer 194. Configured in this manner, the composite construction layer is sandwiched between the two hard layers to provide enhanced resistance to crack penetration deep into the multi-layer construction. Thus, cracks starting at the surface or third layer will run into the second layer, where they will encounter a second phase ductile material that will act to blunt the crack and control crack propagation. Additionally, the design of placing the composite construction layer in the center of the multi-layer construction is expected to consume or absorb impact energy, acting like a soft cushion, thereby protecting the first layer from undesired effects of high impact stresses.

Figure 11:
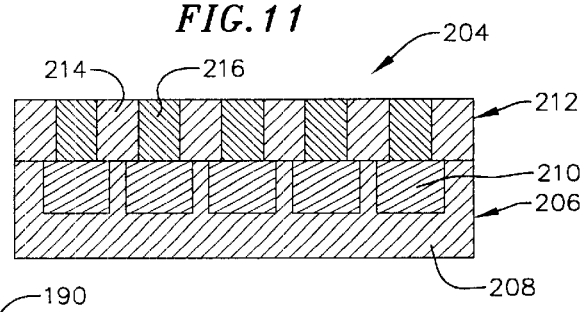
FIG. 11 is a schematic cross-sectional side view of a fifth embodiment multi-layer construction of this invention.

FIG. 11 illustrates, in schematic cross-sectional side view, a fifth embodiment multi-layer construction 204 of this invention comprising two different layers. Unlike the multi-layer composite constructions discussed above, the two layers of the fourth embodiment multi-layer construction are each composite constructions that each comprise an ordered microstructure of two different material phases. A first layer 206 comprises an ordered microstructure made up of a continuous first phase 208, formed from a hard material selected from the group of hard materials discussed above, and a second phase 210 formed from a relatively softer and more ductile material and distributed within the first phase. In an example embodiment, the second phase is exposed along a surface of the first layer that adjoins the second layer.

The second layer 212 comprises an ordered microstructure made up of a continuous first phase 214, formed from a hard material selected from the group of hard materials discussed above, and a second phase 216 formed from a relatively softer and more ductile material and distributed within the first phase. In an example embodiment, the second phase is exposed along a surface of the second layer that adjoins the first layer. Additionally, in an example embodiment, the second phases of both layers are aligned with one another so that are positioned opposite an in contact with one another.

In a preferred fourth embodiment, the volume percentage of hard material, e.g., PCD or PCBN, in the first layer is greater than that in the second layer. In this particular embodiment, the second layer is designed having a lower volume percentage of the hard material than the first layer and, thus is more flexible and capable of absorbing a greater amount of impact energy than the first layer.

Placing the second layer composite construction at the working surface of the multi-layer construction is desired to minimize and control the amount of impact energy that is passed downwardly to the first layer. This multi-layer embodiment is provided to illustrate how composite constructions of this invention can be used as different layers in a multi-layer construction to gain high material capacity against external loading.

Figure 12:
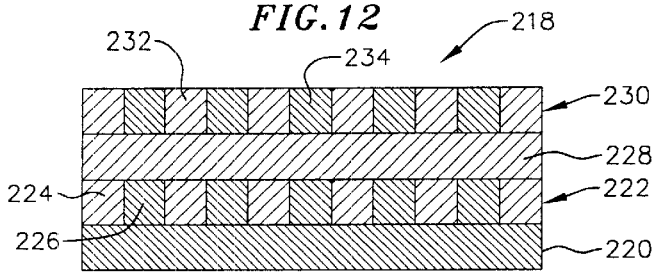
FIG. 12 is a schematic cross-sectional side view of a sixth embodiment multi-layer construction of this invention.

FIG. 12 illustrates, in schematic cross-sectional side view, a sixth embodiment multi-layer construction 218 of this invention comprising four different layers. Like the fourth multi-layer embodiment discussed above, this embodiment also comprises two layers each having an order microstructure of two different material phases. A first layer 220 is formed from a relatively soft material selected from the group of materials discussed above. A second layer 222 is disposed onto a surface of the first layer and comprises an ordered microstructure made up of a continuous first phase 224, formed from a hard material selected from the groups of hard materials discussed above, and a second phase 226 formed from a relatively softer and more ductile material that is distributed within the first phase.

A third layer 228 is disposed onto a surface of the second layer 222 and is formed from a hard material. A fourth layer 230 is disposed onto a surface of the third layer 228 and comprises an ordered microstructure made up of a continuous first phase 232, formed from a hard material selected from the groups of hard materials discussed above, and a second phase 234 formed from a relatively softer and more ductile material that is distributed within the first phase. In a preferred embodiment, the continuous phase of both the second and fourth layers is formed from PCD or PCBN.

In this particular embodiment, detrimental thermal stresses at the interface of the second and fourth layers are expected to be relatively smaller than stresses occurring at the interface of the third layer in the first embodiment multi-layer composite construction illustrated in FIG. 7. Additionally, this particular embodiment is provided to illustrate how composite constructions having ordered microstructures can be arranged with other material layers within the multi-layer construction to provide a desired control of crack propagation though the construction.

The thickness of the individual layers on a multi-layer composite construction will vary based on the material selections as well as the application of the cutting element. It may also be desirable to also make large sections or entire cutting elements out of multi-layer embodiments.

Composite constructions of this invention, whether they are in the form of a single coating layer, a substrate material, or a multi-layer construction, can be used in a number of different applications, such as tools for mining, machining and construction applications, where the combined mechanical properties of high fracture toughness, wear resistance, and hardness are highly desired. Composite constructions of this invention can be used to form wear and cutting components in machine tools and drill and mining bits such as roller cone rock bits, percussion or hammer bits, diamond bits, and substrates for shear cutters.

Figure 14:
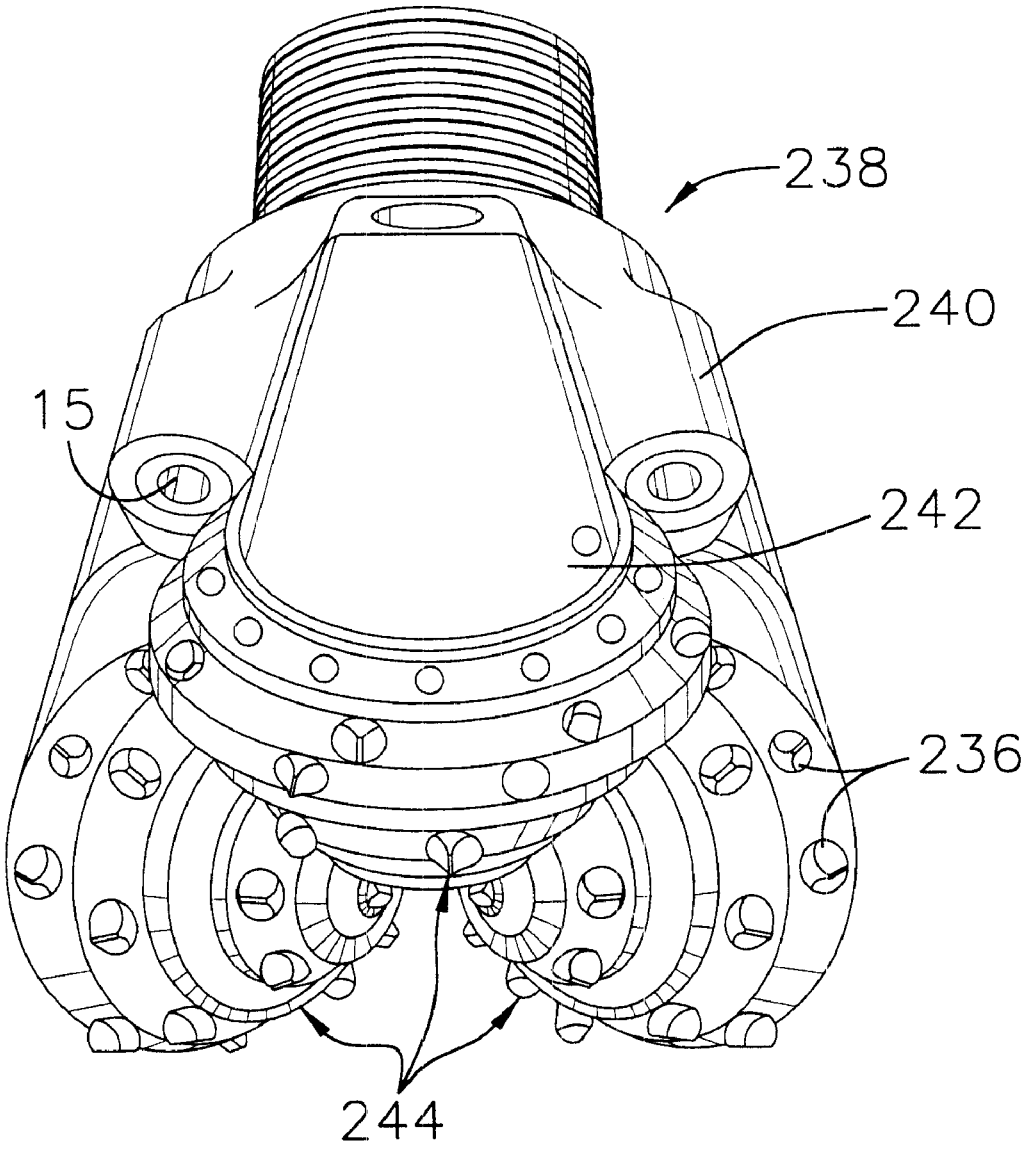
FIG. 14 is a perspective side view of a roller cone drill bit comprising a number of the inserts of FIG. 13.

For example, FIG. 13 illustrates a wear or cutting insert 236 formed from composite constructions of this invention. As mentioned above, the insert can either itself be formed from the composite material, or can comprise a substrate that is coated with a composite construction of this invention along a work surface. FIG. 14 illustrates a roller cone rock bit 238 comprising a body 240 having three legs 242, and a roller cutter cone 244 mounted on a lower end of each leg. The rock bit includes a plurality of the inserts 236 (shown in FIG. 13) that are provided in the surfaces of the cutter cones 244 for bearing on a rock formation being drilled.

Referring to FIG. 15, inserts 236 formed from composite constructions of this invention can also be used with a percussion or hammer bit 246, comprising a hollow steel body 248 having a threaded pin 250 on an end of the body for assembling the bit onto a drill string (not shown) for drilling oil wells and the like. A plurality of the inserts 236 are provided in the surface of a head 252 of the body 248 for bearing on the subterranean formation being drilled.

Figure 16:
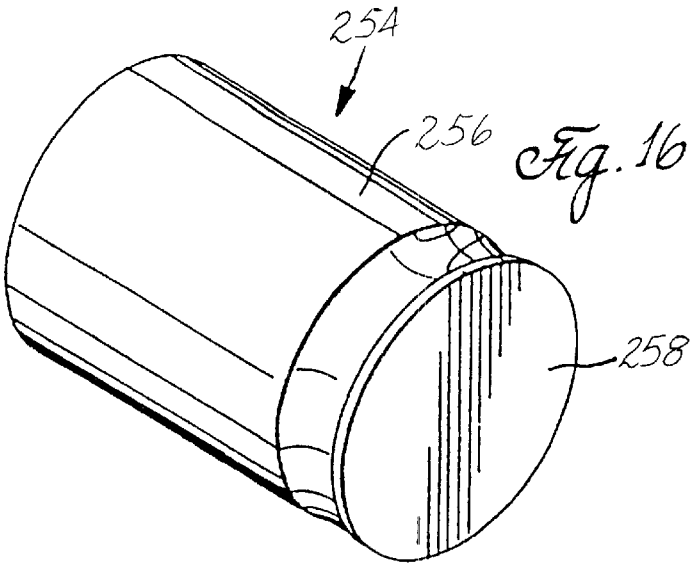
FIG. 16 is a schematic perspective side view of a shear cutter comprising a substrate and/or cutting surface formed a composite construction of this invention.

Referring to FIG. 16, composite constructions of this invention can also be used to form PCD shear cutters 254 that are used, for example, with a drag bit for drilling subterranean formations. More specifically, composite constructions of this invention can be used to form a shear cutter substrate 256 that is used to carry a layer of PCD 258 that is sintered thereto or, alternatively, the entire substrate and cutting surface can be made from the composite construction.

Figure 17:
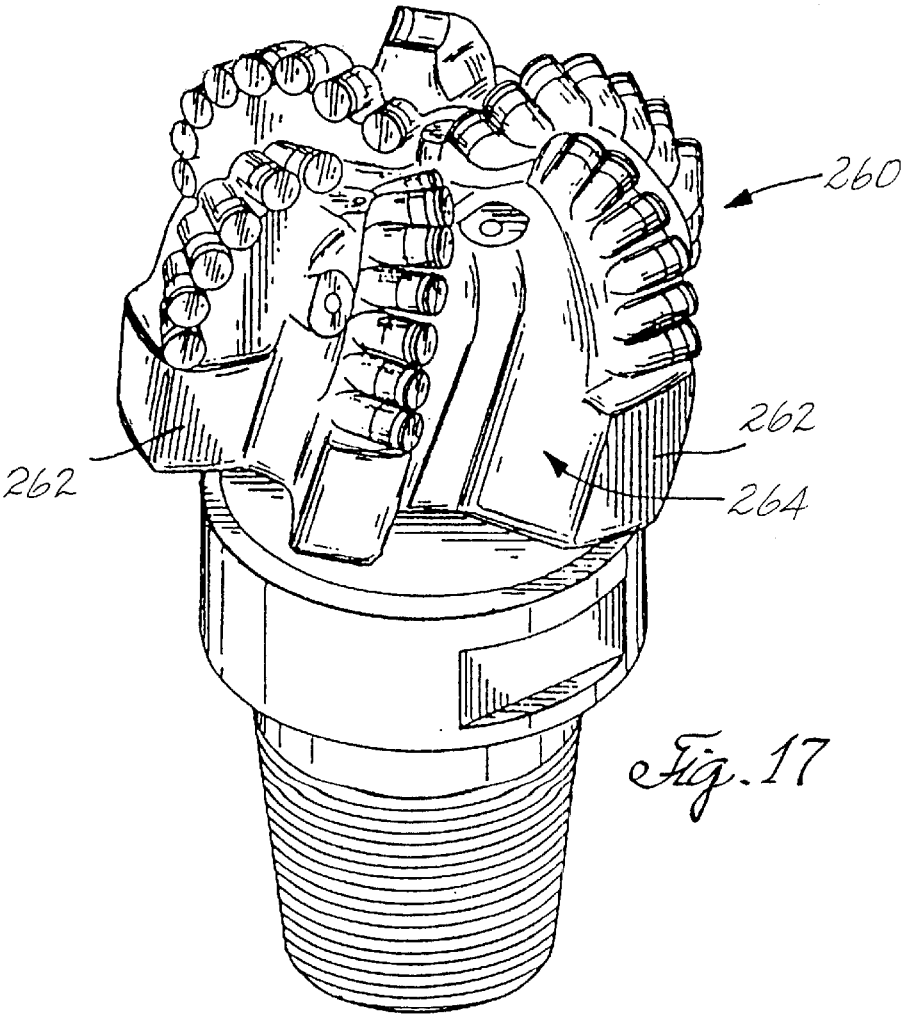
FIG. 17 is a perspective side view of a drag bit comprising a number of the shear cutters of FIG. 16.

Referring to FIG. 17, a drag bit 260 comprises a plurality of such PCD shear cutters 254 that are each attached to blades 262 that extend from a head 264 of the drag bit for cutting against the subterranean formation being drilled.

Although, limited embodiments of composite constructions having ordered microstructures, multi-layer constructions comprising the same, methods of making the same, and applications for the same, have been described and illustrated herein, many modifications and variations will be apparent to those skilled in the art. For example, although composite constructions have been described and illustrated for use with rock bits, hammer bits and drag bits, it is to be understood that composites constructions of this invention are intended to be used with other types of mining and construction tools. Accordingly, it is to be understood that within the scope of the appended claims, composite constructions constructed according to principles of this invention may be embodied other than as specifically described herein.

What is claimed is:

1. A composite construction comprising: an ordered microstructure made up of multiple structural units that each comprise at least a first structural phase and a second structural phase;

wherein the first structural phase comprises a hard material selected from the group consisting of cermet materials, polycrystalline diamond, polycrystalline cubic boron nitride, and mixtures thereof; and wherein the second structural phase comprises a material that is different than that used to form the first structural phase, the second structural phase being in contact with at least a portion of the first structural phase; and wherein the multiple structural units are disposed across a working surface of the composite construction.

2. The composite construction as recited in claim 1 wherein the first structural phase is polycrystalline diamond.

3. The composite construction as recited in claim 1 wherein the second structural phase is formed from a material selected from the group consisting of Co, Ni, Fe, W, Mo, Cu, Al, Nb, Ti, Ta, cermet materials, and alloys thereof.

4. A multi-layer composite construction comprising at least two material layers disposed onto one another, wherein at least one layer is formed from the composite construction of claim 1.

5. The multi-layer composite construction of claim 4 at least one layer is formed from a material that is relatively softer and more ductile than the material used to form the first structural phase.

6. The composite construction as recited in claim 1 wherein one of the first or second structural phases is continuous and substantially surrounds the other of the first or second structural phases.

7. The composite construction as recited in claim 1 wherein each structural unit further comprises at least a third structural phase that is formed from a material different than that used to form the first and second structural phases, and that is in contact with at least one of the first and second structural phases.

8. The composite construction as recited in claim 7 wherein the first and second structural phases that is at least partially surrounded by the third structural phase.

9. The composite construction as recited in claim 8 wherein each structural unit further comprises a fourth structural phase that is formed from a material different than that used to form the first, second and third structural phases, and wherein the fourth structural phase at least partially surrounds the first and second structural phases.

10. The composite construction as recited in claim 7 wherein each structural phase has the same geometric shape.

11. The composite construction as recited in claim 10 further comprising fourth, fifth and sixth structural phases that are formed from materials different from each other and from materials used to form each of the first, second and third structural phases, and wherein each structural phase is substantially hexagonal in the shape.

12. The composite construction as recited in claim 7 wherein each structural unit comprises a core formed from one of the structural phases, which core is surrounded by first and second concentric shells that are formed from the remaining structural phases.

13. The composite construction as recited in claim 1 wherein the multiple structural units forming the microstructure provide a continuous material phase throughout the microstructure.

14. The composite construction as recited in claim 1 wherein at least one of the structural units comprises first and second structural phases that are different from another structural unit.

15. The composite construction as recited in claim 1 wherein each of the structural units comprises the same first and second structural phases.

16. A composite construction comprising:

an ordered microstructure made up of a plurality of structural units that each comprise at least a first and a second structural phase;

wherein the first structural phase comprises a hard material formed from polycrystalline diamond; and wherein the second structural phase comprises a material selected from the group consisting of Co, Ni, Fe, W, Mo, Cu, Al, Nb, Ti, Ta, cermet materials, and alloys thereof, the second structural phase being in contact with at least a portion of the first structural phase; and wherein the multiple structural units are disposed across a working surface of the composite construction.

17. The composite construction as recited in claim 16 wherein the plurality of structural units forming the microstructure provide a continuous material phase throughout the microstructure.

18. The composite construction as recited in claim 17 wherein the continuous material phase comprises the first structural phase.

19. The composite construction as recited in claim 17 wherein the continuous material phase comprises the second structural phase.

20. The composite construction as recited in claim 12 wherein at least one of the structural units comprises first and second structural phases that is different from another structural unit.

21. The composite construction as recited in claim 16 wherein each of the structural units comprises the same first and second structural phases.

22. A multi-layer construction comprising:

a first layer; and a second layer disposed onto a surface of the first layer; wherein at least one of the first or second layers comprises a composite construction having an ordered microstructure made up of multiple structural units that each comprise at least a first structural phase and a second structural phase, wherein the first structural phase comprises a hard material selected from the group consisting of cermet materials, polycrystalline diamond, polycrystalline cubic boron nitride, and mixtures thereof, wherein the second structural phase comprises a material that is different than that used to form the first structural phase, the second structural phase being in contact with at least a portion of the first structural phase.

23. The multi-layer construction as recited in claim 22 wherein the multiple structural units are disposed across a working surface of the composite construction.

24. The multi-layer construction as recited in claim 22 wherein the second structural phase is formed from a material selected from the group consisting of Co, Ni, Fe, W, Mo, Cu, Al, Nb, Ti, Ta, cermet materials, and alloys thereof.

25. The multi-layer construction of claim 22 comprising a third layer disposed onto a surface of the second layer, wherein the first layer comprises the composite construction, the second layer is formed from a hard material selected from the group consisting of cermet materials, polycrystalline diamond, polycrystalline cubic boron nitride, and mixtures thereof, and the third layer is formed from a material that is relatively softer and more ductile than that used to form the second layer.

26. The multi-layer construction of claim 25 wherein the first structural phase is continuous through the first layer, and the second structural phase is distributed within the first structural phase.

27. The multi-layer construction of claim 26, wherein the composite construction comprises a third structural phase formed from the same group of hard materials used to form the first structural phase, and wherein the second structural phase is in the form of a shell that surrounds the third structural phase.

28. The multi-layer construction of claim 22 comprising a third layer disposed onto a surface of the second layer, wherein the first layer comprises the composite construction, and the second and third layers are each formed from a material that is relatively softer and more ductile than that used to form the composite construction hard phase.

29. The multi-layer construction of claim 28 wherein the first structural phase is continuous and the second structural phase is distributed throughout the first structural phase, and wherein the composite construction further comprises a third structural phase that surrounds the second structural phase.

30. The multi-layer construction of claim 29 wherein the second and third structural phases are each formed from the group of materials selected from the group consisting of Co, Ni, Fe, W, Mo, Cu, Al, Nb, Ti, Ta, cermet materials, and alloys thereof.

31. The multi-layer construction as recited in claim 22 wherein the first and second layers each comprise the composite construction.

32. The multi-layer construction as recited in claim 31 wherein the first structural phase in each of the first and second layers is continuous.

33. The multi-layer construction as recited in claim 31 wherein the volume percent of the first structural phase in the first layer is different than that of the second layer.

34. The multi-layer construction as recited in claim 22 further comprising:

a third layer disposed onto a surface of the second layer; and a fourth layer disposed onto a surface of the third layer;

wherein the first and third layers are each formed form the composite construction and the first layer forms a working surface of the construction.

35. The multi-layer construction as recited in claim 34 wherein the first structural phase in each of the first and third layers is continuous.

36. The multi-layer construction as recited in claim 34 wherein the second layer is formed from a hard material selected from the group consisting of cermet materials, polycrystalline diamond, polycrystalline cubic boron nitride, and mixtures thereof.

37. The multi-layer construction as recited in claim 36 wherein the fourth layer is formed from the group of materials selected from the group consisting of PCD, PCBN, Co, Ni, Fe, W, Mo, Cu, Al, Nb, Ti, Ta, cermet materials, and alloys thereof.

38. A multi-layer construction comprising: a first layer; and a second layer disposed onto a surface of the first layer; and a third layer disposed onto a surface of the second layer;

wherein the second layer comprises a composite construction having an ordered microstructure made up of multiple structural units that each comprise at least a first structural phase and a second structural phase, wherein the first structural phase comprises a hard material selected from the group consisting of cermet materials, polycrystalline diamond, polycrystalline cubic boron nitride, and mixtures thereof, wherein the second structural phase comprises a material that is different than that used to form the first structural phase, the second structural phase being in contact with at least a portion of the first structural phase; and wherein the first and third layers are each formed from the group of materials selected from the group consisting of Co, Ni, Fe, W, Mo, Cu, Al, Nb, Ti, Ta, cermet materials, and alloys thereof.

39. A roller cone drill bit comprising:

a body having a number of legs that extend therefrom;

cutting cones rotatably disposed on an end of each leg;

a plurality of cutting inserts disposed in the cutting cones, wherein at least a portion of the cutting inserts are formed from a composite construction having an ordered microstructure made up of multiple structural units that each comprise at least a first structural phase and a second structural phase;

wherein the first structural phase comprises a hard material selected from the group consisting of cermet materials, polycrystalline diamond, polycrystalline cubic boron nitride, and mixtures thereof; and wherein the second structural phase comprises a material that is different than that used to form the first structural phase, the second structural phase being in contact with at least a portion of the first structural phase; and wherein the multiple structural units are disposed across a working surface of the composite construction.

40. The drill bit as recited in claim 39 wherein the cutting inserts are made entirely from the composite construction.

41. A drag drill bit comprising:

a body having a head and having a number of blades extending away from a head surface, the blades being adapted to engage a subterranean formation during drilling;

a plurality of shear cutters disposed in the blades to contact the subterranean formation during drilling, each shear cutter comprising a substrate and a layer of cutting material disposed thereof, the cutting material comprising a composite construction having an ordered microstructure made up of multiple structural units that each comprise at least a first structural phase and a second structural phase;

wherein the first structural phase comprises a hard material selected from the group consisting of cermet materials, polycrystalline diamond, polycrystalline cubic boron nitride, and mixtures thereof; and wherein the second structural phase comprises a material that is different than that used to form the first structural phase, the second structural phase being in contact with at least a portion of the first structural phase; and wherein the multiple structural units are disposed across a working surface of the composite construction.

* * * * *

UNITED STATES PATENT AND TRADEMARK OFFICE

CERTIFICATE OF CORRECTION

PATENT NO. : 6,361,873 B1
DATED : March 26, 2002
INVENTOR(S) : Zhou Yong et al.

It is certified that error appears in the above-identified patent and that said Letters Patent is hereby corrected as shown below:

Title page,
Item [57], ABSTRACT,
Line 13, replace “structures” with -- structure --.

Column 2,
Line 28, replace “that” with -- than --.

Column 3,
Line 25, before “a composite construction” insert -- in --.
Line 61, replace “4,604.106” with -- 4,604,106 --.

Column 5,
Line 38, replace “The Materials” with -- The materials --.

Column 6,
Line 3, replace “configurations” with -- configuration --.

Column 8,
Line 17, before “is similar” delete “has”.

Column 9,
Line 4, after “structural phases” delete “78,”
Line 27, replace “from to” with -- from the --.
Line 32, after “invention” insert -- which --.

Column 11,
Line 27, replace “a PCB” with -- of PCB --.

Column 12,
Line 22, replace “convention PCD” with -- conventional PCD --.
Line 42, replace “layer 182” with -- layer 184 --.

Column 13,
Line 53, replace “that are positioned opposite an in” with -- that they are positioned opposite and in --.

Column 14,
Line 37, replace “though” with -- through --.

UNITED STATES PATENT AND TRADEMARK OFFICE

CERTIFICATE OF CORRECTION

PATENT NO. : 6,361,873 B1
DATED : March 26, 2002
INVENTOR(S) : Zhou Yong et al.

It is certified that error appears in the above-identified patent and that said Letters Patent is hereby corrected as shown below:

Column 15,
Line 27, replace “composites” with -- composite --.

Column 16,
Line 8, replace “that is” with -- are --.
Line 22, after “hexagonal in” delete -- the --.
Line 61, replace “claim 12” with -- claim 16 --.
Line 63, replace “is different” with -- are different --.

Column 18,
Line 6, change “form” to -- from --.

Signed and Sealed this

Eighth Day of April, 2003

JAMES E. ROGAN
*Director of the United States Patent and Trademark Office*